US006710325B2

(12) United States Patent
Kuhar

(10) Patent No.: US 6,710,325 B2
(45) Date of Patent: Mar. 23, 2004

(54) LIGHT CURTAIN MOUNTING SYSTEM WHEREIN HOUSING AND MOUNTING BRACKET INCLUDE CURVED SURFACES

(75) Inventor: Edward C. Kuhar, Concord, OH (US)

(73) Assignee: Dynapar Corporation, Gurnee, IL (US)

( * ) Notice: Subject to any disclaimer, the term of this patent is extended or adjusted under 35 U.S.C. 154(b) by 271 days.

(21) Appl. No.: 10/029,104

(22) Filed: Dec. 20, 2001

(65) Prior Publication Data

US 2003/0116697 A1 Jun. 26, 2003

(51) Int. Cl.[7] ..... G08B 29/00; G08B 13/18

(52) U.S. Cl. ..... 250/221; 250/239; 340/555; 359/821

(58) Field of Search ..... 250/221, 222.1, 250/239, 216; 340/555–557; 248/481, 485–487; 359/798, 819, 821–823; 362/147; 296/152; 324/177

(56) References Cited

U.S. PATENT DOCUMENTS

| | | | | |
|---|---|---|---|---|
| 4,433,907 | A | * | 2/1984 | Tarsia |
| 4,520,262 | A | | 5/1985 | Denton |
| 4,626,053 | A | | 12/1986 | Fayfield |
| 4,644,329 | A | | 2/1987 | Brueske |
| 5,198,661 | A | | 3/1993 | Anderson et al. |
| 5,260,765 | A | | 11/1993 | Hawkinson |
| 2003/0106992 | A1 | * | 6/2003 | Koyama et al. ..... 250/221 |

* cited by examiner

*Primary Examiner*—Stephone B. Allen
(74) *Attorney, Agent, or Firm*—Watts Hoffmann Co., L.P.A.

(57) ABSTRACT

A mounting apparatus for mounting optics of a light curtain. The apparatus includes a light curtain optics housing and a mounting bracket. The housing includes a curved mounting surface that extends along a portion of a length of the housing. The mounting bracket is connected to the curved mounting surface such that the mounting bracket can be longitudinally adjusted with respect to the optics housing. The mounting bracket includes a curved surface and an adjustment slot that allow for rotational adjustment with respect to the mounting bracket.

15 Claims, 7 Drawing Sheets

LIGHT CURTAIN MOUNTING SYSTEM WHEREIN HOUSING AND MOUNTING BRACKET INCLUDE CURVED SURFACES

TECHNICAL FIELD

The present invention relates in general to light curtains which detect the intrusion of human limbs or other objects into a protective zone and, more particularly, the present invention relates to a system for mounting light curtains.

BACKGROUND ART

Light curtains are commonly employed in a variety of industrial applications to detect the intrusion of objects, such as hands or feet of personnel, into or around a prescribed area or zone of protection. Typical applications for light curtains include providing operator protection around machinery, such as punch presses, brakes, molding machines, automatic assembly equipment, coil winding machinery, robot operation, casting operations and the like. Light curtain systems employ invisible pulsed infrared light beams which project across a plane along the zone to be protected. Unintended blockage of the light beams by an object, such as the operator's hand, is sensed such that a control circuit triggers a warning signal, shuts the machinery down or otherwise safeguards the area.

In order to function properly, transmitters and receivers of the light curtain must be properly aligned. In the past, alignment of the transmitters and receivers of the light curtain was very difficult. Transmitters and receivers of the light curtain must be properly positioned and oriented with respect to a horizontal axis, a vertical axis and depth axis. In the past brackets have been used to mount the components of the light curtain. Some prior art brackets are rigidly attached to the light curtain, making it difficult to properly orient the light curtain compartment about a vertical axis. Shims have been used to orient light curtain transmitters and receivers in a vertical axis.

U.S. Pat. No. 5,198,661 to Anderson illustrates mounting brackets that allow for rotative movement of the light curtain components with respect to the brackets. The mounting brackets of the '661 patent are longitudinally fixed to ends of the light curtain component components.

What is needed is a light curtain mounting system that allows for rotational and longitudinal movement of light curtain components with respect to the mounting bracket. Such a system greatly eases alignment of the light curtain transmitters and receivers by allowing longitudinal and rotational adjustment of the light curtain with respect to the brackets.

DISCLOSURE OF INVENTION

The present disclosure concerns an apparatus for mounting optics of a light curtain that allows for longitudinal and rotational adjustment between a light curtain optics housing and a mounting bracket. The light curtain optics housing includes a curved mounting surface that extends along a length of the housing. The mounting bracket is connected to the curved mounting surface, such that the mounting bracket can be longitudinally adjusted with respect to the housing. The mounting bracket includes a curved inner surface and an adjustment slot through the curved inner surface that allows rotational adjustment of the housing with respect to the mounting bracket.

In embodiments of the invention, the curved mounting surface of the light curtain is defined by an outer surface of a pair of opposing mounting flanges that extend from the housing.

A threaded fastener that passes through the adjustment slot in the bracket is used to connect the mounting bracket to the curved mounting surface. The mounting flanges define a fastener retaining channel that allows for longitudinal adjustment of the bracket with respect to the housing. The housing is connected to the bracket by a fastener constrained in the fastener retaining channel and a second fastener that engages the curved outer surface of the mounting bracket. The center of the radius of the curvature of the curved mounting surface of the light curtain optics housing is located at a central axis of the optics mounting housing. A washer is used that has a curved surface and a flat surface. The fastener used to connect the housing to the bracket engages the flat surface of the washer to bring the curved surface of the washer into engagement with the curved outer surface of the bracket to bring the bracket into tight engagement with the housing.

In one embodiment, an internally threaded fastener is constrained within the channel defined between the pair of opposed flanges of the light curtain housing. The washer having a curved surface and a flat surface engages the curved outer surface of the mounting bracket. An externally threaded fastener engages the flat surface of the washer, extends through the washer and the slot in the mounting bracket and engages the internally threaded fastener to connect the bracket to the housing.

A method of mounting and aligning optics of a light curtain is performed using the disclosed apparatus. The curved mounting surface of the light curtain housing is loosely connected to the curved mounting surface of the mounting bracket. The curved mounting surface of the light curtain housing is rotated with respect to the curved mounting surface of the mounting bracket to an aligned position. The connection between the housing and the mounting bracket is tightened. These and other advantages of the present invention will become apparent upon reading the following detailed description in view of the drawings.

BEST MODE FOR CARRYING OUT THE INVENTION

Figure 1:
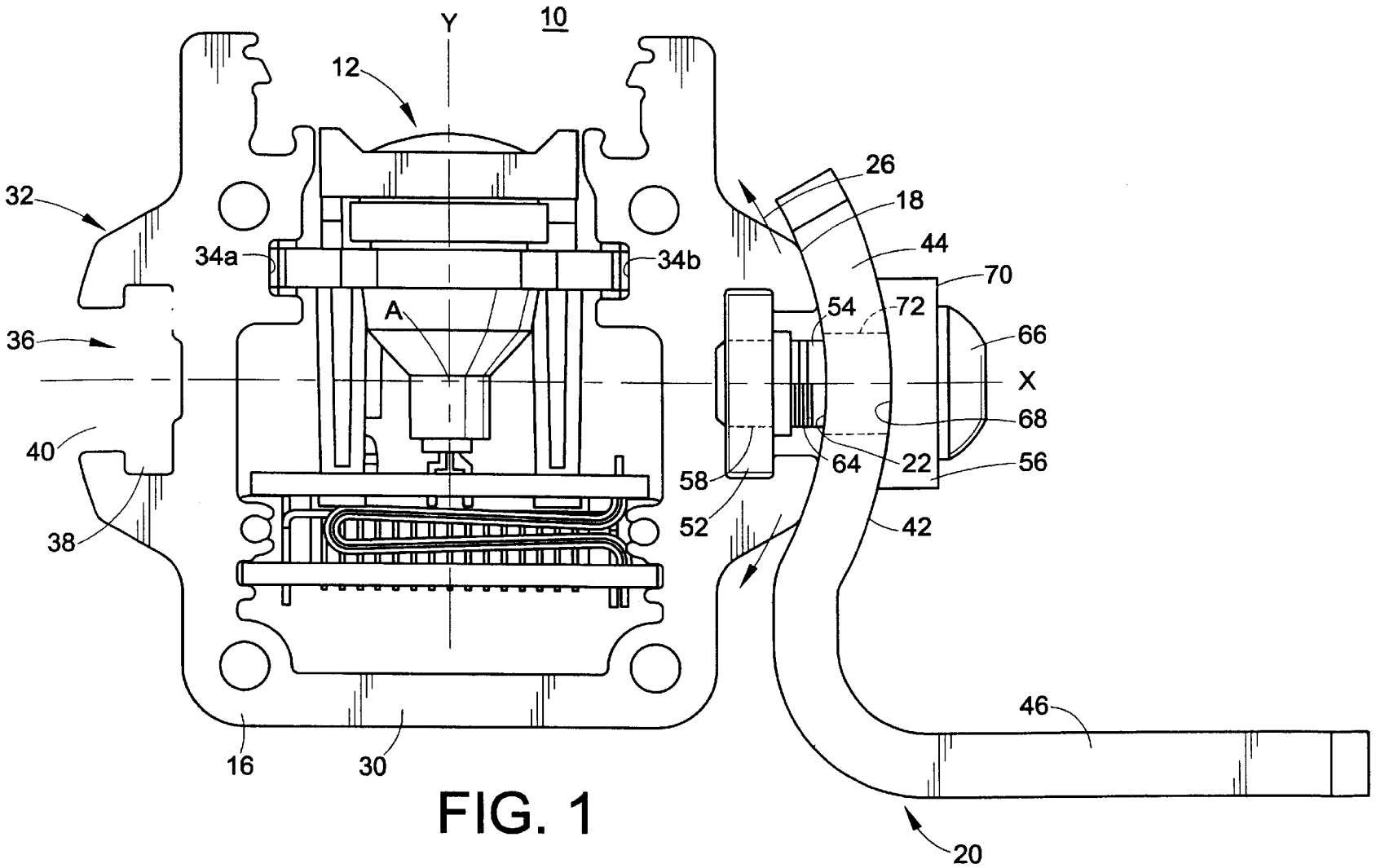
FIG. 1 is a top plan view of a system for mounting a light curtain.

The present disclosure is directed to a system 10 for mounting optics 12 of a light curtain 14. The system 10 includes a light curtain optics housing 16 that includes curved mounting surface 18 and a mounting bracket 20 connected to the curved mounting surface 18. The mounting bracket 20 includes a curved inner surface 22 and adjustment slots 24. The curved inner surface 22 and the adjustment slot 24 allow rotational adjustment 26 of the housing 16 with respect to the mounting bracket 20 when the connection between the bracket 20 and the housing 16 is slightly loosened.

Figure 3:
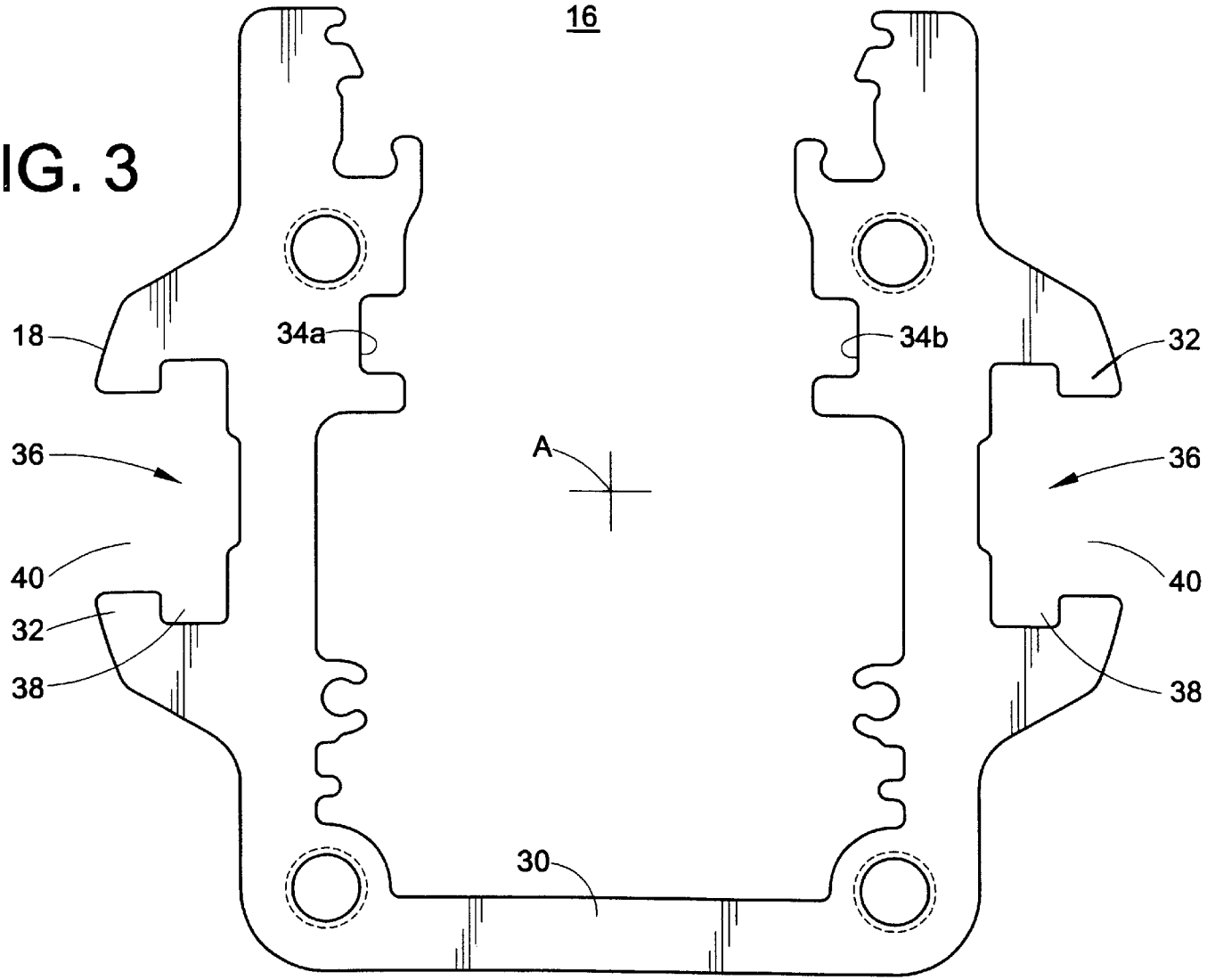
FIG. 3 is a plan view of a housing for light curtain optics.

Referring to FIGS. 1 and 3, the illustrated housing includes a main body portion 30 and a pair of opposing mounting flanges 32. The main body portion 30 is configured to receive optics 12 of the light curtain 14 and to hold the optics in position. The illustrated main body portion 30 includes a pair of slots 34, 34 that hold the optics in place. It should be readily apparent to those skilled in the art that any main body portion configuration may be used to hold the optics 12 in place. The configuration of the main body portion 30 shown in FIGS. 1 and 3 is for illustrative purposes only.

The pair of opposing mounting flanges 32 is used to connect the housing 16 to the mounting bracket 20. In the illustrated embodiment, the opposing mounting flanges extend along the length L of the housing, allowing for longitudinal adjustment of the housing 16 with respect to brackets 20. In the illustrated embodiment, two pairs of opposing mounting flanges 32 are included on the housing to facilitate use of mounting brackets on either side of the housing 16.

Figure 2:
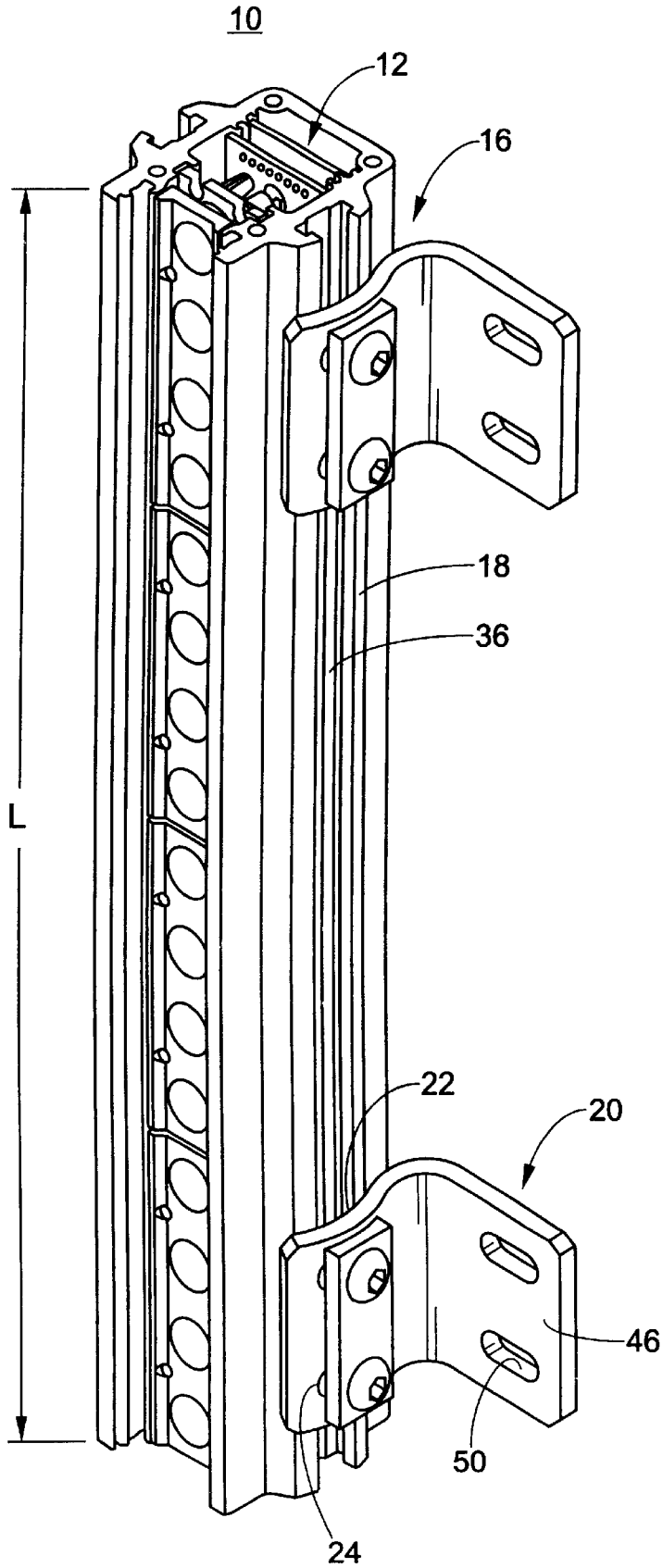
FIG. 2 is a perspective view of a system for mounting a light curtain.

The pair of opposing mounting flanges 32 define the curved mounting surface 18. A channel 36 is defined between the pair of opposing mounting flanges 32. The channel 36 includes a relatively wide cavity 38 adjacent to the main body portion 30 of the housing 16 and a narrower cavity 40 that extends from the wider cavity 38 through the surface 18. Referring to FIG. 2, the illustrated channel 36 extends along substantially the entire length of the housing 16. The illustrated housing 16 is extruded. It should be readily apparent to those skilled in the art that the housing 16 could be constructed by other methods, such as molding or die casting.

Figure 6A:
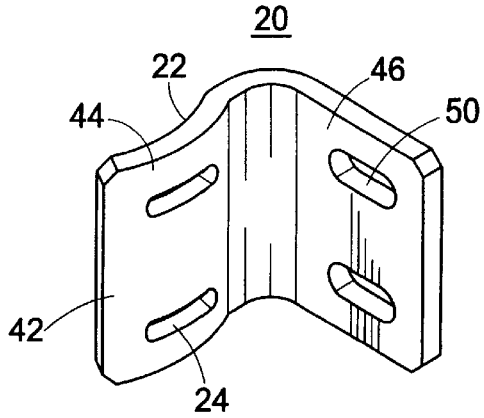
FIG. 6A is a perspective view of a mounting bracket of one embodiment.
Figure 6B:
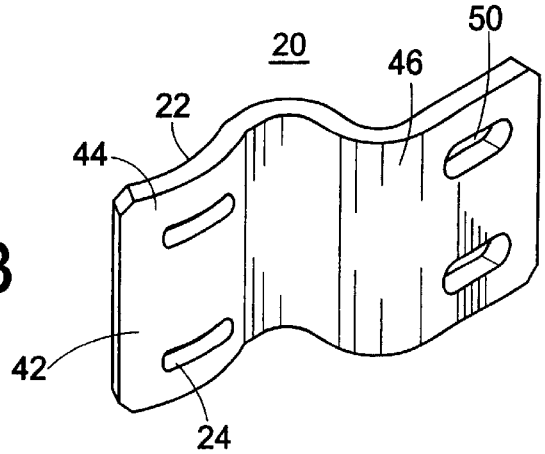
FIG. 6B is a perspective view of a mounting bracket of one embodiment.
Figure 6C:
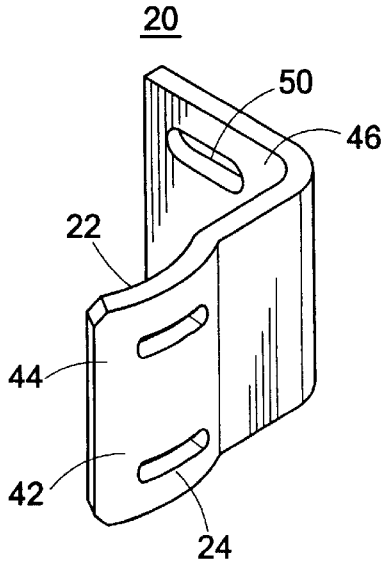
FIG. 6C is a perspective view of a mounting bracket of one embodiment.

Referring to FIGS. 6A, 6B and 6C, the illustrated mounting brackets 20 include a curved inner surface 22 that mates with the curved mounting surface 18 of the housing 16. The illustrated brackets 20 also include a curved outer surface 42. The illustrated brackets 20 are made from a metal plate and is bent to form a curved flange 44 and a mounting flange 46. The curved flange 44 includes the curved inner surface 22 and the curved outer surface 42. Slots 24 are included in the curved flange 44. The slots 24 in the curved flange 44 allow for rotation of the housing 16 with respect to the mounting bracket 20. In the illustrated embodiment, the housing 16 rotates about a central axis A when the housing 16 is rotated with respect to the mounting bracket 20. The central axis A coincides with the central axis of the curved mounting surface 18 of the housing 16 and the curved inner surface 22 of the mounting bracket.

Figure 4:
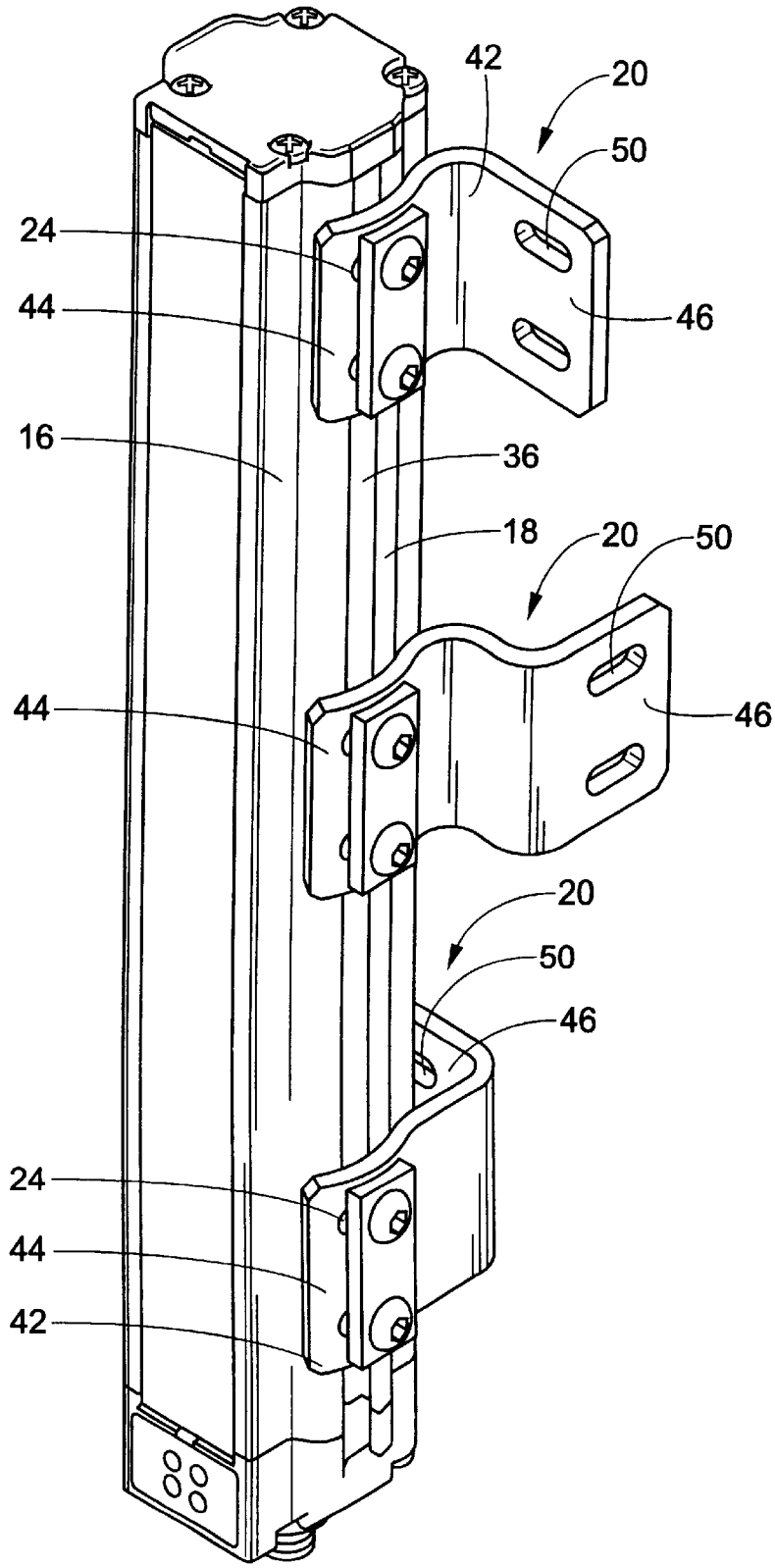
FIG. 4, is a perspective view of mounting brackets of three embodiments attached to a oil light curtain.
Figure 5A:
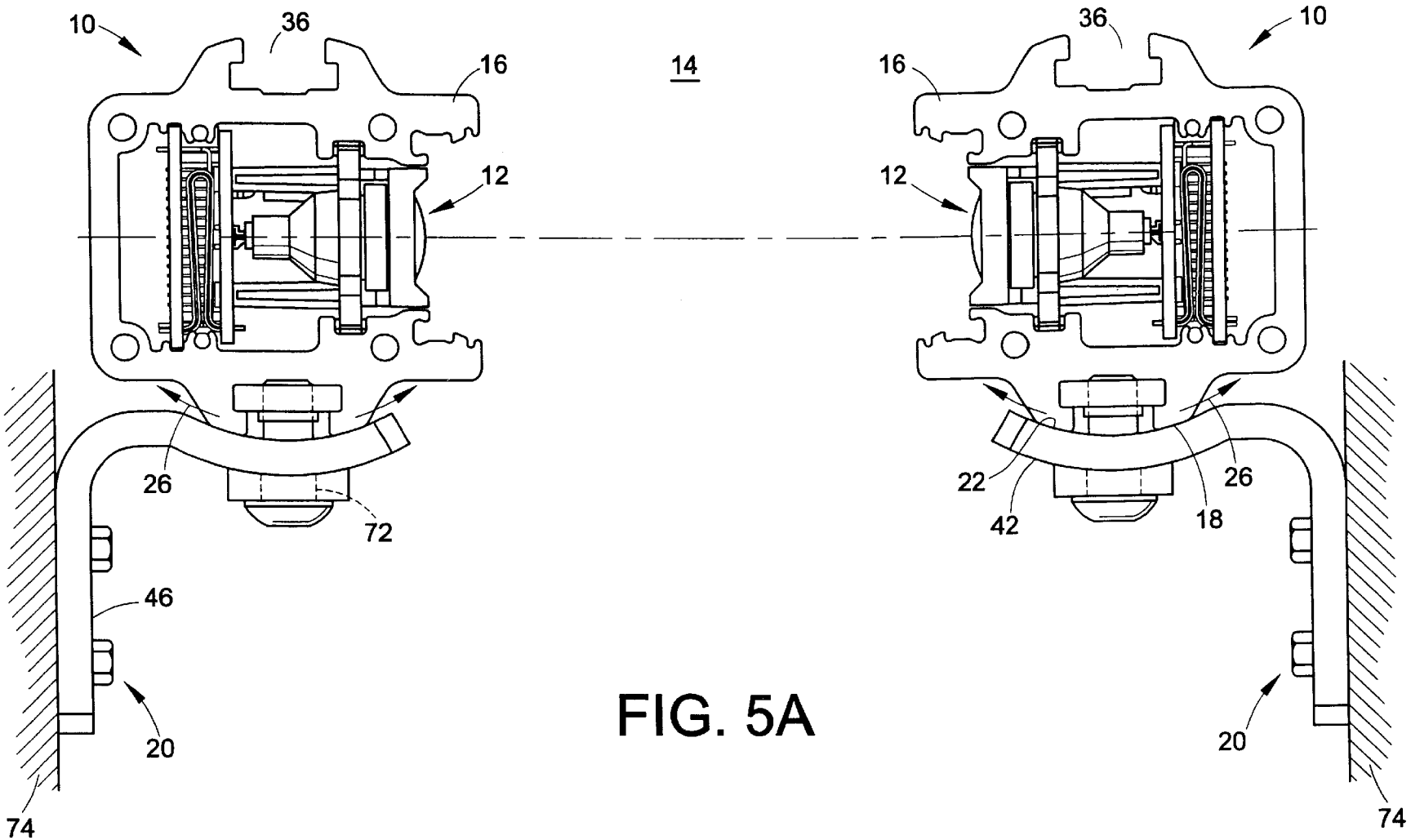
FIG. 5A is a top elevational view of an aligned light curtain.
Figure 5B:
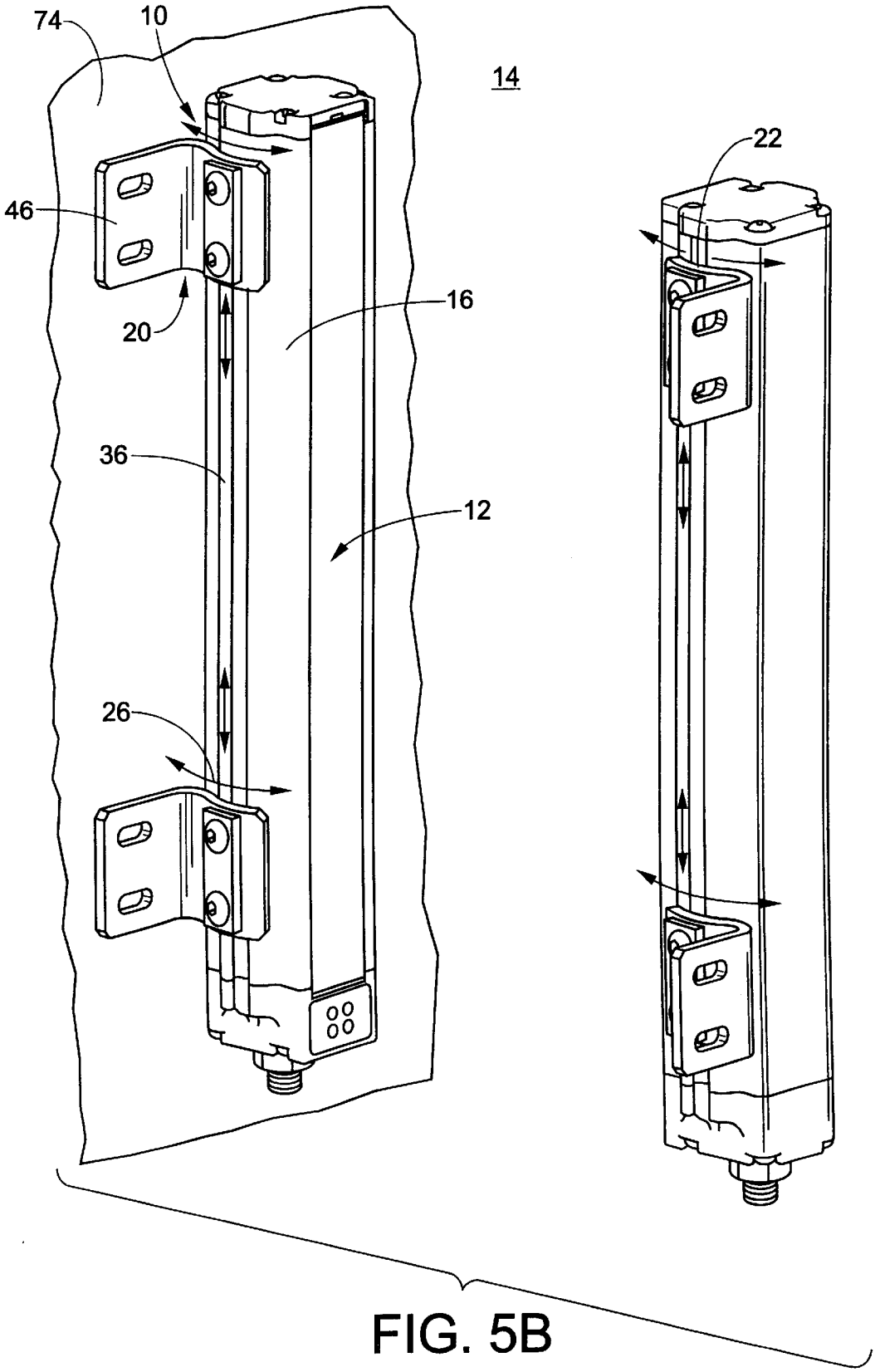
FIG. 5B is a perspective view of an aligned light curtain.

Referring to FIG. 4, the mounting flange 46 may be bent at various angles to the curved flange 44 to accommodate mounting to different surfaces. The bracket configuration shown at the top of FIG. 4 facilitates mounting of housings of a light curtain 14 as depicted in FIGS. 5A and 5B. The bracket configuration shown in the middle of FIG. 4 accommodates mounting of a light curtain parallel to a wall or surface of a machine. In one embodiment, the bracket configuration shown in the middle of FIG. 4 is used to detect passage of an object into an opening, such as a door. The bracket configuration shown at the bottom of FIG. 4 is used to mount the housing of a light curtain in applications where spaced is limited.

In the illustrated embodiment, slots 50 are included in the mounting flange. The mounting flange 46 facilitates connection of the mounting bracket 20 to a wall or a surface of a machine that the light curtain is being mounted on. In the illustrated embodiment, a plurality of mounting brackets 20 are used to mount the housing 16.

Referring to FIG. 1, the illustrated mounting bracket 20 is connected to the housing 16 with an internally threaded member 52 an externally threaded member 54 and a washer 56. In the exemplary embodiment, the internally threaded member slidably fits within the channel 36. In the exemplary embodiment, two internally threaded members are used that each include a threaded hole 58. The two internally threaded members correspond to the slots 24 in the curved flange 44. The illustrated internally threaded member 52 fits within the wide cavity 38 of the channel 36. In the illustrated embodiment, the internally threaded member is a weld tab nut. It should be readily apparent to those skilled in the art that the configuration of the internally threaded member 52 may vary from the illustrated internally threaded member. For example, the internally threaded member 52 may include a wide portion that fits within the wide cavity 38 of the channel 36 and a narrower portion that extends into the narrow cavity 40. In one embodiment, two internally threaded members are replaced with a single member having two spaced apart threaded holes corresponding to the slots 24 in the bracket 20. It should also be readily apparent to those skilled in the art that the internally threaded member 52 could be replaced with a member that fits within the channel 36 that has one or more studs extending from it.

Referring to FIG. 1, the externally threaded member 54 has a threaded portion 64 and a head 66. The threads of the threaded portion 64 correspond to the threads of the internally threaded member 52. In the exemplary embodiment, two externally threaded members 54 are used, corresponding to two internally threaded members or the two spaced apart threaded holes of the internally threaded member. It should be readily apparent to those skilled in the art that an internally threaded member can be used in place of the externally threaded member when a member including a stud is slidably disposed in the channel 36. In the illustrated embodiment, the externally threaded member 54 is a button head cap screw having a large bearing area and a small hex drive.

The illustrated washer 56 has a curved side 68 and a flat side 70. The curved side 68 is concave and has a radius of curvature that corresponds to the radius of curvature of the curved outer surface 42 of the bracket 20. The flat side 70 provides a surface for the externally threaded member 54 to flushly abut against and keeps the externally threaded member in alignment with the horizontal axis of the housing. In the illustrated embodiment, the washer 56 includes two holes 72 that are aligned with the threaded holes 58 of the internally threaded members and the slots 24 in the curved flange 44.

The externally threaded members 54 are inserted through the holes 72 in the washer 56 through the slots 24 in the bracket 20 and are threaded into the internally threaded member 52 to constrain the mounting bracket 20 to the housing 16. The slots 24 allow the housing 16 to be rotated with respect to the mounting bracket 20 to pivotally adjust the housing 16 about the axis A. Conventional fasteners are inserted through slots 50 in the flange 46 to mount the brackets 20 to a wall or surface of a machine.

Referring to FIG. 2, an XYZ axis, which may correspond to the horizontal axis, depth axis and vertical axis, respectively, of the light curtain is depicted near the top of the illustrated light curtain 14. When mounting the light curtain 14, linear adjustment along the X axis is allowed by the slots in the bracket 20. If a mounting surface is not true, rotational adjustment about the X axis is allowed for by using shims between one or more of the brackets 20 and the wall 74. The brackets 20 are mounted to a true wall 74 or shims are used if linear adjustment along the Y axis is required. Rotational adjustment about the Y axis is allowed for by the slots 50 in the mounting flange 46. The internally threaded member(s) 52 can slide within the channel 36 in the housing 16. The slidable movement of the internally threaded member(s) 52 in the channel 36 allows for linear adjustment along the Z axis. The slots 24 allow the housing 16 to be rotated with respect to the bracket 44, allowing for rotational adjustment about the Z axis.

The disclosed mounting system allows the installer to measure and level the light curtain 14 with ease without ever having to turn on the system. Once the curtain is turned on, the installer can rotate the housing 16 to align the beams of the transmitters of the light curtain with the receivers of the light curtain by rotating the housing(s) 16 with respect to the mounting brackets 20. The disclosed system reduces the number of shims that are required to mount the light curtain and makes alignment much easier. The illustrated system allows for plus or minus 8° of rotational adjustment about the X axis.

Although the present invention has been described with a degree of particularity, it is the intent that the invention include all modifications and alterations falling within the spirit and scope of the following claims.

I claim:

1. An apparatus for mounting optics of a light curtain, comprising:

a) a light curtain optics housing including a curved mounting surface that extends along a length of said housing; and b) a mounting bracket connected to said curved mounting surface such that said mounting bracket can be longitudinally adjusted with respect to said housing, said mounting bracket including a curved surface and an adjustment slot that allow rotational adjustment of said housing with respect to said mounting bracket.

2. The apparatus of claim 1 wherein said curved mounting surface is defined by an outer surface of a pair of opposing mounting flanges that extend from said housing.

3. The apparatus of claim 1 wherein said mounting bracket is connected to said curved mounting surface by a threaded fastener that passes through said adjustment slot in said bracket.

4. The apparatus of claim 1 wherein said curved mounting surface is defined by an outer surface of a pair of opposing mounting flanges that extend from said housing, said mounting flanges defining a fastener retaining channel, said housing being connected to said bracket by a first fastener constrained in said fastener retaining channel and a second fastener that engages a curved outer surface of said mounting bracket.

5. The apparatus of claim 1 wherein a center of a radius of curvature of said curved mounting surface is located at a central axis of said optics mounting housing.

6. The apparatus of claim 1 further comprising a washer having a curved surface and a flat surface and a fastener, said fastener engaging said flat surface of said washer to bring said curved surface of said washer into engagement with a curved outer surface of said bracket to connect said bracket to said housing.

7. An apparatus for mounting optics of a light curtain, comprising:

a) a light curtain optics housing including a pair of opposed flanges that define a curved mounting surface and a channel; and b) a mounting bracket connected to said curved mounting surface of said pair of opposing flanges, said mounting bracket including a curved inner surface and an adjustment slot that allow rotational adjustment of said housing with respect to said mounting bracket.

8. The apparatus of claim 7 wherein said mounting bracket is connected to said curved mounting surface by a threaded fastener that passes through said adjustment slot in said bracket.

9. The apparatus of claim 7 wherein said housing is connected to said bracket by a first fastener constrained in said channel and a second fastener that engages a curved outer surface of said mounting bracket.

10. The apparatus of claim 7 wherein a center of a radius of curvature of said curved mounting surface is located at a central axis of said optics mounting housing.

11. The apparatus of claim 7 further comprising a washer having a curved surface and a flat surface and a fastener, said fastener engaging said flat surface of said washer to bring said curved surface of said washer into engagement with a curved outer surface of said bracket to connect said bracket to said housing.

12. The apparatus of claim 7 further comprising an internally threaded fastener constrained in said channel and an externally threaded fastener that engages said bracket, extends through said slot and engages said internally threaded fastener to connect said bracket to said housing.

13. An apparatus for mounting optics of a light curtain, comprising:

a) a light curtain optics housing including a pair of opposed flanges that define a curved mounting surface and a channel;

b) a mounting bracket connected to said curved mounting surface of said pair of opposing flanges, said mounting bracket including a curved inner surface, a curved outer surface and an adjustment slot;

c) an internally threaded fastener constrained within said channel;

d) a washer having a curved surface and a flat surface, said curved surface of said washer engaging said curved outer surface of said mounting bracket; and e) an externally threaded fastener that engages said flat surface of said washer, extends through said washer and said slot and engages said internally threaded fastener to connect said bracket to said housing.

14. The apparatus of claim 13 wherein a center of a radius of curvature of said curved mounting surface is located at a central axis of said optics mounting housing.

15. A method of mounting and aligning optics of a light curtain, comprising:

a) loosely connecting a curved mounting surface of a light curtain housing to a curved mounting surface of a mounting bracket; and b) rotating said curved mounting surface of said light curtain housing with respect to said curved mounting surface of a mounting bracket; and c) tightening a connection between said curved mounting surface of said light curtain housing to said curved mounting surface of said mounting bracket.

* * * * *